US005975413A

United States Patent [19]

Moen

[11] Patent Number: 5,975,413

[45] Date of Patent: Nov. 2, 1999

[54] SHIPPING CONTAINER

[76] Inventor: Lenard E. Moen, 7914 Michigan, Whittier, Calif. 90602

[21] Appl. No.: 09/149,262

[22] Filed: Sep. 8, 1998

[51] Int. Cl.[6] ..... B65D 5/32

[52] U.S. Cl. ..... 229/122.24; 229/122.32; 493/84; 493/89

[58] Field of Search ..... 229/122.24, 122.25, 229/122.26, 122.32; 493/84, 89, 162, 906

[56] References Cited

U.S. PATENT DOCUMENTS

| | | | |
|---|---|---|---|
| 1,997,717 | 4/1935 | Claff . | |
| 2,090,343 | 8/1937 | Claff . | |
| 3,559,867 | 2/1971 | Muskopf et al. | 229/122.32 |
| 3,744,702 | 7/1973 | Ellison . | |
| 3,850,362 | 11/1974 | Stollberg, et al. . | |
| 3,863,831 | 2/1975 | Wozniacki et al. | 229/122.26 |
| 4,138,053 | 2/1979 | Gardner . | |
| 4,177,935 | 12/1979 | Centanni | 229/122.32 |
| 4,310,323 | 1/1982 | Moen | 493/89 |
| 4,341,337 | 7/1982 | Beach, Jr. et al. | 229/122.32 |
| 4,693,413 | 9/1987 | McFarland et al. . | |
| 4,706,809 | 11/1987 | Halsell | 229/122.32 |
| 4,793,494 | 12/1988 | Gordon, Jr. | 229/122.24 |
| 5,000,372 | 3/1991 | Hollander et al. | 493/84 |
| 5,040,696 | 8/1991 | Liebel | 229/122.32 |
| 5,163,611 | 11/1992 | Singer | 493/89 |
| 5,361,974 | 11/1994 | Earl et al. | 229/122.32 |
| 5,427,306 | 6/1995 | Petriekis et al. . | |
| 5,439,133 | 8/1995 | Stone | 229/122.32 |
| 5,450,998 | 9/1995 | Esse et al. . | |
| 5,505,368 | 4/1996 | Kanter et al. . | |
| 5,669,551 | 9/1997 | Sigloch | 229/122.26 |

*Primary Examiner*—Gary E. Elkins
*Attorney, Agent, or Firm*—Frederick E. Mueller

[57] ABSTRACT

A shipping container of corrugated liner board material comprising an erectable body wrap and a folded pair of bi-wall blanks. Each end wall of the container is a composite comprising an end wall panel of the body blank overlying an end wall of a bi-wall blank and a distal end of a side wall of the other of the pair of folded bi-wall blanks. The body wrap blank has integral corner post flanges flanking opposite sides of its end wall panels and a pair of window flanges flanking opposite sides of its central bottom panel.

8 Claims, 2 Drawing Sheets

SHIPPING CONTAINER

BACKGROUND OF THE INVENTION

The present invention relates to paperboard containers and, more particularly, to a shipping container of corrugated liner board material.

RSC (regular slotted container) and HSC (half slotted container) boxes are in common use in shipping a variety of products where it is desired to have complete protection of the product, i.e., protection against both shipping damage and pilferage. However, such containers have distinct disadvantages which are inherent in their basic design. Thus, in the case of both the RSC and HSC containers, the bottom closure comprises foldable bottom flaps which are interleaved when folded to provide a two-ply floor for the product, the floor having gaps. In the case of the RSC container, the lid is also comprised of interleaved foldable top flaps. The double thickness of the material in both the bottom and top of such containers comprising the overlapping portions of the folded flaps contribute nothing to the stacking strength of the container and thus are useful only in the sense of protection of the product against pilferage. Accordingly, there has been a long felt need for a shipping container design, which without increasing the amount of corrugated board used, results in a shipping container of increased stacking strength, that has a gapless floor, and yet provides complete protection of the shipped product against pilferage.

Although sometimes so employed, HSC and RSC containers are ill adapted to serve as display containers. When so used, they are provided with a tear out panel or panels in a side wall or opposite side walls of the container. When these are removed, the stacking strength of the container is greatly reduced, comprising substantially only the single ply or thickness of corrugated liner board in the opposite end walls. These end walls, although intact, are then prone to buckling in view of the removal of the tear out panels of the side walls.

It is thus an object of the present invention to overcome the foregoing and other disadvantages of HSC and RSC containers.

SUMMARY OF THE INVENTION

The invention comprises an improved shipping container of corrugated liner board. The invention further comprises a set of a pair of bi-wall blanks in combination with a body wrap blank and a method for their assembly. The body wrap blank may optionally be formed with a pair of integral panel areas at opposite ends which, when erected, co-act to provide a lid or cover for the completed container.

Each bi-wall blank comprises a rectangular piece of liner board having a corrugated medium sandwiched between an opposite pair of paper liners or layers. The blank is traversed by a fold line, such as a press score on one of the liners, preferably in a direction paralleling the flutes of the corrugated media and corresponding to the vertical dimension of the completed box. The fold line divides the bi-wall blank into a pair of wall panel areas comprising a side wall and an end wall, the two walls being of either the same or dissimilar lengths, depending on the desired dimensions of the completed box.

The body blank is also made of a corrugated liner board material of substantially rectangular planform and of a weight that may be the same as or different from the stock of which the companion bi-wall blanks are made. A transverse parallel pair of fold lines, which may be press scores on an inside paper liner, divide the blank into a central bottom panel and a pair of end wall areas on opposite ends of the bottom panel. The corrugated medium of the body wrap blank is preferably oriented in a direction to orient the flutes of the end wall areas vertically when the box is completed. Opposite sides of the bottom panel and both of the end wall areas have integrally formed marginal flaps which will be adhesively secured to confronting marginal areas of the erected bi-wall members upon erection of the body wrap blank.

In the fully erected container, the marginal flaps of the end wall areas comprise rigid corner posts which in combination with the double thickness laminated end walls provide a container of improved stacking strength. Optionally, opposite ends of the body wrap blank may each be formed with a cover or lid panel area that is integral with the corresponding end wall panel. Each lid panel area may also be flanked by a pair of marginal flaps such that when the lid panels are moved to a closed position to cover the box opening, the marginal flaps may be turned into engagement with and secured to upper end marginal areas of the erected bi-wall panels.

The container of this invention is also adapted to serve as a display container without any significant loss of its stacking strength. As each of the opposite side walls is framed by a pair of corner posts and a bottom horizontal window flange, a tear out panel of any desired figuration may be performed in the side wall which can be manually removed thus exposing a contents of the container to view and removal through the thus formed display opening. As the two-ply end walls of the container remain intact, reinforced by the corner posts, the container stacking strength is maintained despite the removal of the material of the tear out panels.

DESCRIPTION OF THE PREFERRED EMBODIMENT

Figure 1:
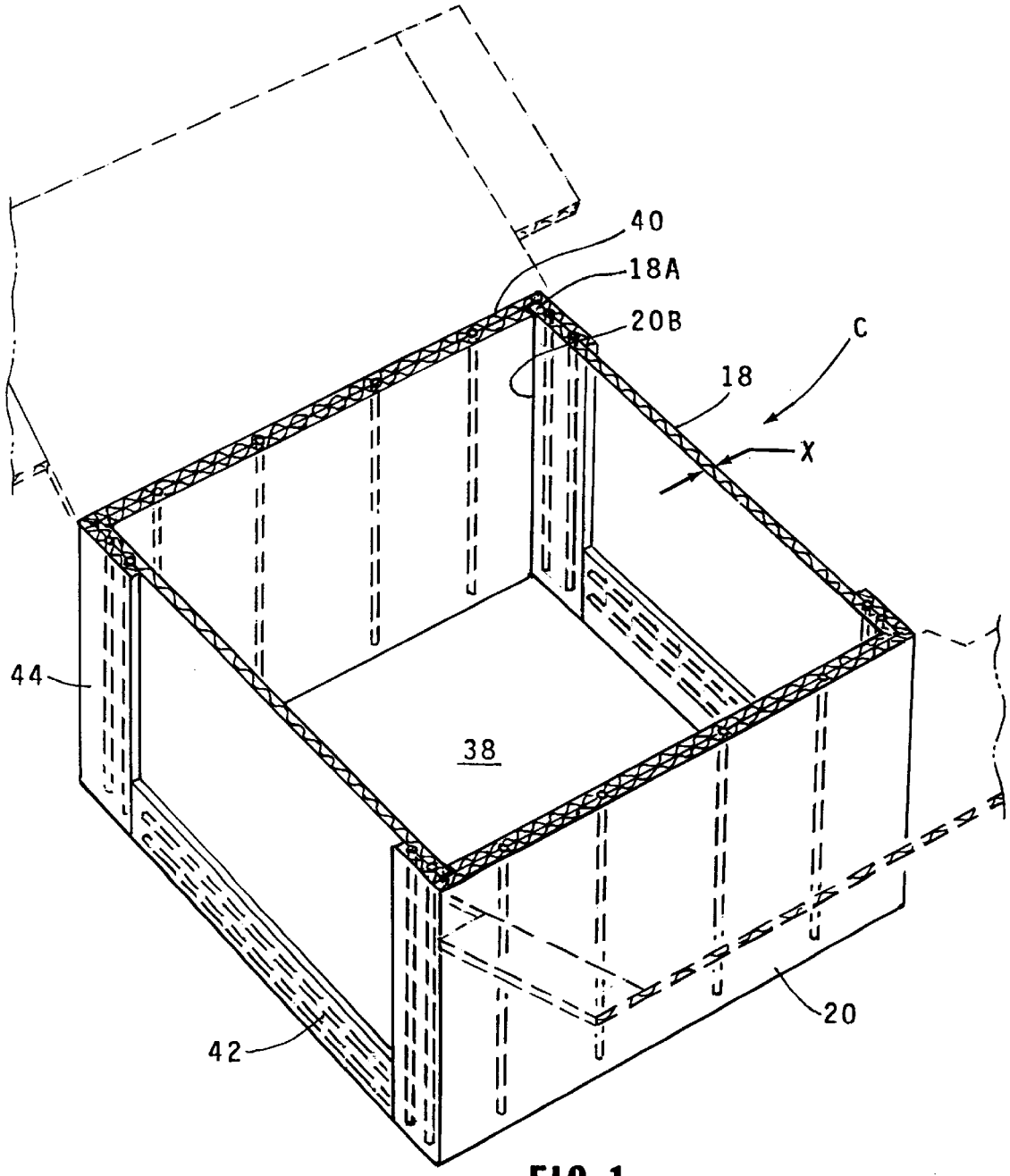
FIG. 1 is a perspective view of a presently preferred embodiment of my container invention and also illustrates, in phantom outline, optional cover panels integrated with the body wrap and shown in a container open position.

Before explaining the invention in detail, it is to be understood that the invention is not limited in its application to the details of construction and arrangements of the components set forth in the following description or illustrated in the drawings. The invention is capable of other embodiments and of being practiced and carried out in various ways. Also, it is to be understood that the phraseology and terminology (e.g., top, bottom, inner, outer, end wall, side wall) employed herein is for the purposes of description and should not be regarded as limiting.

Figure 2:
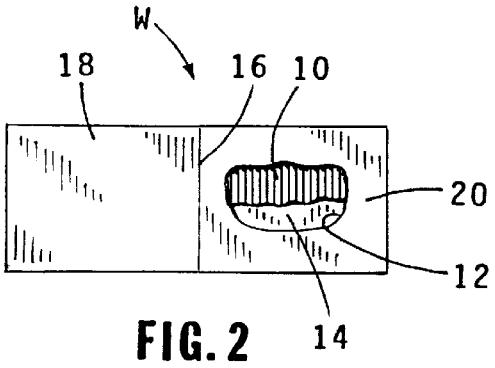
FIG. 2 is a plan view of one of the bi-wall blanks, with a portion of one liner cut away to reveal the orientation of the flutes of the corrugated medium and to show the other liner.

FIG. 2 is a plan view of a flat bi-wall blank W of rectangular planform. Blank W is a piece of corrugated liner board comprising a corrugated medium 10 of paper sandwiched between and adhesively secured to an opposite pair of planar paper liners comprising inner layer 12 and outer layer 14. Blank W is traversed by a fold line 16 in a direction corresponding to the vertical dimension of a completed container and parallel to the flutes of the corrugated medium 10. Typically, the fold line 16 may be a press score impressed on the inner liner 12 of the blank, although other means of defining a fold line may be used such as, e.g., a perf score, as is well understood in the corrugated board making art. In any event, the area of the blank W is thus divided into a pair of wall areas on opposite sides of the fold line 16. For convenience of description, one of these will be referred to as end wall 20 and the other as side wall 18. As will presently appear, walls 18 and 20 need not necessarily be of the same size since the fold line 16 is not to be considered as merely a mid line of the blank W. In other words, the walls 18 and 20 may be of radically dissimilar lengths. Thus, if a narrow box were desired, fold line 16 would be shifted far to the right from the position of FIG. 2.

Figure 3:
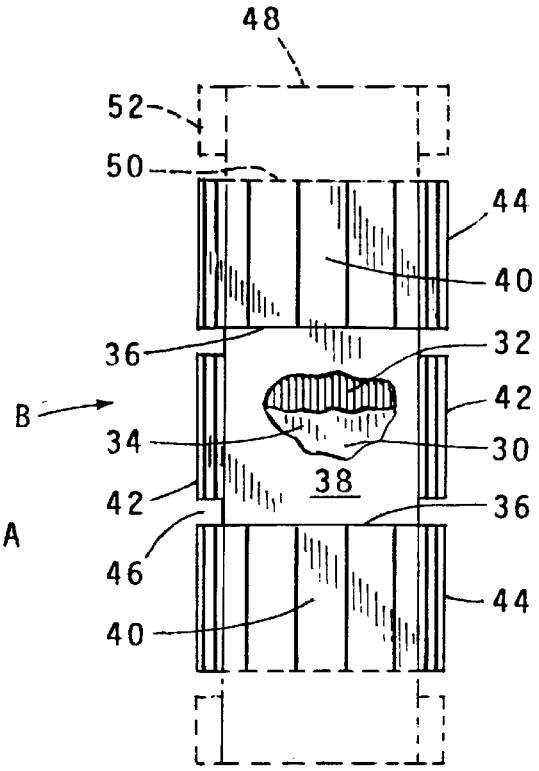
FIG. 3 is a plan view of a presently preferred form of body blank for the container, with a portion of one liner cut away to show the other liner and the orientation of the flutes of the corrugated material.

As shown in FIG. 3, body blank B is of substantially rectangular planform and comprises an inner layer 30, corrugated medium 32 and outer paper layer 34. Traversing the long axis of the piece, a pair of parallel fold lines 36 divide the area of the blank B into a substantially rectangular central bottom panel 38 flanked at opposite ends by a pair of end wall panel areas 40. Along each of its opposite sides, the bottom panel 38 is formed with a marginal pair of integrally formed window flanges 42. In similar fashion, each of the pair of end wall panel areas 40 is provided on opposite sides with an integral pair of corner post flaps 44. Preferably, the corner post flaps 44 extend linearly the full length of the end wall areas 40 corresponding to the vertical dimension of the completed container. In that case, marginal flanges 42 of the bottom panel 38 are shorter than the corresponding dimension of the bottom panel to define notches 46 at opposite ends of the flanges to leave clearances for the rotation of the corner post flaps 44 into position when the container is assembled. Preferably, each notch 46 is of substantially the same width as a flap 44.

Alternatively, adjacent ends of the flanges 42 and corner post flaps 44 could be beveled, or the horizontal flanges 42 lengthened and the corner post flaps 44 shortened to define alternative joint geometries, as well understood in the art.

If it is desired to have a container with an integral cover or lid, rather than a separately formed tray lid or the like, such may be provided by the cover flaps 48 shown in phantom outline in FIG. 3. Each of these is an integral extension of one of the opposite ends of the blank B whose inside boundary comprises a fold line 50 coincident with an upper end boundary of one of the end wall areas 40. The opposite sides of each cover flap 48 may be provided with integral foldable flaps 52.

Figure 4:
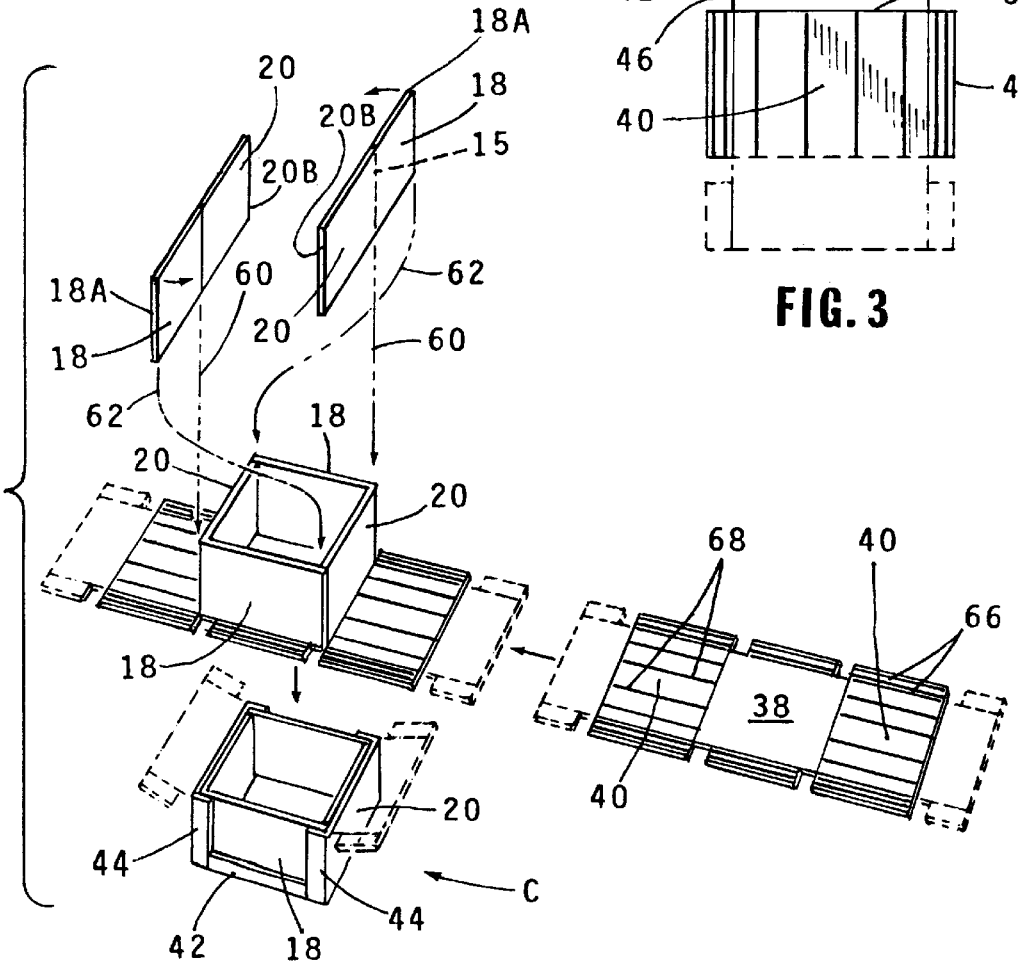
FIG. 4 is a schematic diagram illustrating the relative orientation of a pair of bi-wall blanks and a corresponding body wrap blank in being brought together during assembly of a container.

A completed container C of the invention is shown in FIG. 1, fabricated from a companion set of blanks comprising an identical pair of the bi-wall blanks W and a single body blank B. As is indicated in FIG. 4, an identical pair of the bi-wall blanks W are disposed in laterally spaced parallel vertical planes with their end wall areas 20 in registration with one another and in superposition within and over opposite ends of the central bottom panel 38 of the blank B. As indicated by lead lines 60, the vertical fold lines 16 of the pair of blanks W are disposed in intersecting alignment with diagonally opposite corner areas of panel 38. The sidewalls extend in opposite directions and each sidewall 18 of the pair of blanks W is rotated 90 degrees about the corresponding fold line 16 to bring its distal end 18A into abutment with a butt edge 20B of the other blank W, as indicated by lead lines 62. An inner wall of the completed container thus comprises the length of an end wall 20 of a blank W and a thickness X of the other blank W.

When the folded pair of blanks W are thus in centered registration with the bottom panel 38, that is to say that the outer layers 14 of the folded pair of blanks W are included within the confines of the central bottom panel 38 of the blank B, body blank B may thereafter be erected therearound. Thus, as indicated in FIG. 4, the body blank B is preferably provided on its inside liner 30 with spaced, parallel plural beads of glue 66 extending along the pairs of flaps 42 and 44. Also, a plurality of parallel glue strips 68 are provided on the inside layer 30 of the end wall areas 40 of the blank B. After the folded pair of blanks W are in proper registration with the central bottom panel 38 of the blank W, the end wall areas 40 of the body blank can be erected into mutual adhesive engagement with the outer layers 14 of the pair of blanks W against end walls 20. Thereafter, the marginal flaps 42 and 44 may be turned into flush adhering engagement with corresponding marginal areas of the outer surface of the pair of sidewalls 18. Optionally, mechanical fasteners such as staples could be used in lieu of glue.

As contrasted to RSC and HSC containers, in the completed container C of this invention the container bottom comprises a single solid ply of the corrugated board material. The corrugated board material which would otherwise be used in the floor of an RSC or HSC container, in the case of the container C provides double laminated end walls and rigid laminated corner posts. Thus, a container of greatly increased stacking strength is provided, especially when the flutes of the end wall material are vertical. Additionally, each of the sidewall areas of the container C is provided with a laminated frame embodied by the horizontal flange 42 and corner post flanges 44. Thus, without sacrificing the structural integrity of the container, each of the sidewalls can be provided with tear out panels either framed by the inner edges of the flange 42 and flaps 44, or some other tear out shape included within that boundary.

I claim:

1. A container comprising an erected body blank of a corrugated board material and an erected pair of bi-wall blanks of a corrugated board material, said erected body blank having a bottom panel and an erected, upstanding pair of end wall panel areas at opposite ends of said bottom panel, each of said bi-wall blanks comprising an end wall and a side wall on opposite sides of a fold line of said bi-wall blank, said end wall and side wall being orthogonally related to one another when said bi-wall blank is erected, said erected pair of bi-wall blanks being disposed within the perimeter of said bottom panel of said erected body blank such that opposite sides of said container comprise said side walls of said pair of bi-wall blanks and opposite ends of said container comprise a composite of said end wall panel areas of said body blank and said end walls of said bi-wall blanks.

2. A container as in claim 1 in which said fold lines of said pair of erected bi-wall blanks are disposed at diagonally opposite corners of said bottom panel of said body blank.

3. A container as in claim 1 in which each of said side walls of said erected bi-wall blanks has a distal end disposed against a butt end of said end wall of the other of said pair of bi-wall blanks.

4. A container as in claim 1 in which a fastening means secures each of said end walls of said erected pair of bi-wall blanks to said end wall panels of said erected body blank.

5. A container as in claim 4 in which said fastening means comprises an adhesive.

6. A container as in claim 1 in which said body blank is formed with an integral pair of foldable flanges along opposite sides of said bottom panel and said pair of end wall panels of said body blank are each formed with an opposite pair of marginal corner post flaps, said erected body blank having said flanges disposed in upstanding relation to said bottom panel and secured to one of said side walls of said erected pair of bi-wall panels, said erected body blank having said marginal corner post flaps rotated into engagement with and engaging edge portions of said side walls of said erected pair of bi-wall blanks.

7. A set of blanks for assembly into a container, said set comprising:

a body blank of a corrugated board material, a parallel spaced apart pair of fold lines extending transversely across said body blank to define a central bottom panel and a pair of end wall panel areas at opposite ends of said bottom panel;

and a pair of bi-wall blanks of a corrugated board material, each of said bi-wall blanks comprising an end wall and a side wall on opposite sides of a fold line of said bi-wall blank, said side wall of said bi-wall blank having a length substantially the same as that of a side of said bottom panel of said body blank, said end wall of said bi-wall blank having a length less than that of an end of said bottom panel by an amount substantially the same as the thickness of the material of which said bi-wall blank is made, whereby when said body blank and said pair of bi-wall blanks are erected an end wall of the resulting container comprises a composite of an end wall area of said body blank and, in combination, an end wall of a bi-wall blank and a distal end portion of the side wall of the other of said pair of bi-wall blanks.

8. A method of forming a container from a preformed flat body blank and a preformed pair of bi-wall blanks, each of the blanks being of a corrugated board material comprising a fluted media, the body blank comprising a central bottom panel having a pair of opposite ends comprising an erectable pair of end wall panels, each of the bi-wall blanks comprising an end wall and a side wall on opposite sides of a transverse fold line of the bi-wall blank, each side wall having a length substantially the same as that of said of the bottom panel of the body blank, each end wall of a bi-wall blank having a length less than that of an end of the bottom panel by an amount substantially the same as the thickness of the material of which the bi-wall blank is made, said method comprised in steps of:

folding each of the bi-wall blanks into orthogonal relationship of its end wall and its side wall, arranging the folded bi-wall blanks such that each has a distal end of its side wall in abutment with a butt edge of the side wall of the other folded bi-wall blank, thus defining a substantially rectangular inner wall structure of the container, placing the pair of folded bi-wall blanks and the central bottom panel of the body blank into mutually centered contacting relationship; and thereafter erecting the opposite end wall panels of the body wall blank into mutual contact with the end walls of the folded pair of bi-wall blanks and distal ends of the sidewalls of the folded pair of bi-wall blanks.

* * * * *